US007003907B2

(12) United States Patent
Leung

(10) Patent No.: US 7,003,907 B2
(45) Date of Patent: Feb. 28, 2006

(54) INERTIA-DRIVEN CHANGING DISPLAY

(76) Inventor: Hon Wang Leung, Room A1, 3/F, 46 Bedford Road, Tai Kok Tsui, Kowloon (HK)

( * ) Notice: Subject to any disclaimer, the term of this patent is extended or adjusted under 35 U.S.C. 154(b) by 0 days.

(21) Appl. No.: 10/722,925

(22) Filed: Nov. 26, 2003

(65) Prior Publication Data

US 2004/0231207 A1 Nov. 25, 2004

(30) Foreign Application Priority Data

May 19, 2003 (CN) ..... 03131192

(51) Int. Cl.
*G09F 11/02* (2006.01)

(52) U.S. Cl. ..... 40/485; 40/493; 40/424

(58) Field of Classification Search ..... 40/493, 40/503–507, 485

See application file for complete search history.

(56) References Cited

U.S. PATENT DOCUMENTS

| | | | | | |
|---|---|---|---|---|---|
| 403,037 | A * | 5/1889 | Castle | 40/485 |
| 1,356,585 | A * | 10/1920 | Zadig | 116/51 |
| 1,683,990 | A * | 9/1928 | Schick | 40/485 |
| 1,875,676 | A * | 9/1932 | Harold | 359/520 |
| 2,753,830 | A * | 7/1956 | Pillsbury et al. | 116/37 |
| 2,798,321 | A * | 7/1957 | Duff | 40/493 |
| 2,828,562 | A * | 4/1958 | Warren | 40/493 |
| 3,513,800 | A * | 5/1970 | Radgens | 116/37 |
| 4,449,167 | A * | 5/1984 | Cohen | 362/269 |
| 6,182,599 | B1 * | 2/2001 | Sung | 116/35 R |

* cited by examiner

*Primary Examiner*—Cassandra Davis
(74) *Attorney, Agent, or Firm*—Alix, Yale & Ristas, LLP

(57) ABSTRACT

A display panel includes a casing, a number of parallel display elements rotatably mounted within the casing, a mass that can move within the casing, and a mechanism with which the mass interacts to affect rotation of the display elements. A base attaches the display panel to a motor vehicle dashboard for observation by passengers, such that upon acceleration and deceleration of the motor vehicle, the mass moves to affect periodic display changes.

12 Claims, 8 Drawing Sheets

INERTIA-DRIVEN CHANGING DISPLAY

BACKGROUND OF THE INVENTION

The present invention relates to an inertia-driven changing display. More particularly, although not exclusively, the invention relates to a display panel that can be mounted upon the dashboard of a motor vehicle and having a number of parallel display elements. The elements together produce a display image for viewing by a passenger. The display elements can rotate to produce different images upon acceleration and deceleration of the vehicle, or when the vehicle traverses over a crest or through a trough in the road and without reliance on external electrical input.

Display panels having a plurality of triangular cross-sectioned display elements are known. These are usually large advertising poster-sized devices in which the display elements are rotated by a motor and chain drive mechanism to change the overall display. That is, each of the three display faces of each element has a portion of an image that becomes contiguous with other image portions of the neighbouring display elements upon periodic rotation of each element through 120°. Sometimes, each display element is internally illuminated by shining light through transparency images upon each face.

The idea of the rotating display elements might be taken from the above advertising panels in a downscaled—say monitor-sized device for use in advertising to a small audience such as the passengers of a taxi for example. However, the power requirements and control circuitry and mechanical mechanism needed to affect periodic rotation of the display elements would render such a device cost-ineffective not only in terms of manufacture, but also installation.

OBJECTS OF THE INVENTION

It is an object of the present invention to overcome or substantially ameliorate at least one of the above disadvantages and/or more generally to provide an inertia-driven changing display panel.

DISCLOSURE OF THE INVENTION

There is disclosed herein a display panel comprising:

a casing, a plurality of parallel display elements rotatably mounted within the casing, a mass that can move within the casing, and a mechanism with which the mass interacts such that upon movement of the mass relative to the casing, the mechanism affects rotation of the display elements.

Preferably each display element is triangular in cross-section.

Preferably, the display panel further comprises a link connecting each display element such that rotation of one display element causes rotation of the other elements.

The display panel might further comprise a driven gear at one end of one of the display elements and wherein the mechanism comprises an arm to an end of which the mass is attached, the arm being connected at its other end to a drive gear in mesh with the driven gear.

The display panel might further comprise a ratchet by which the arm is attached to the driving gear.

Preferably, the display panel further comprises a spring attached to the mass to define a limit of movement of the mass and to provide rebound energy thereto.

The display panel might further comprise a base to which the casing is pivotally attached.

Preferably, the base has a double-sided adhesive by which it can be attached to a motor vehicle dashboard.

Preferably, one of the display elements has a multi-faced cam interacting with an elastic piece to hold that element in a fixed display orientation until it is turned by the mechanism.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figure 1:
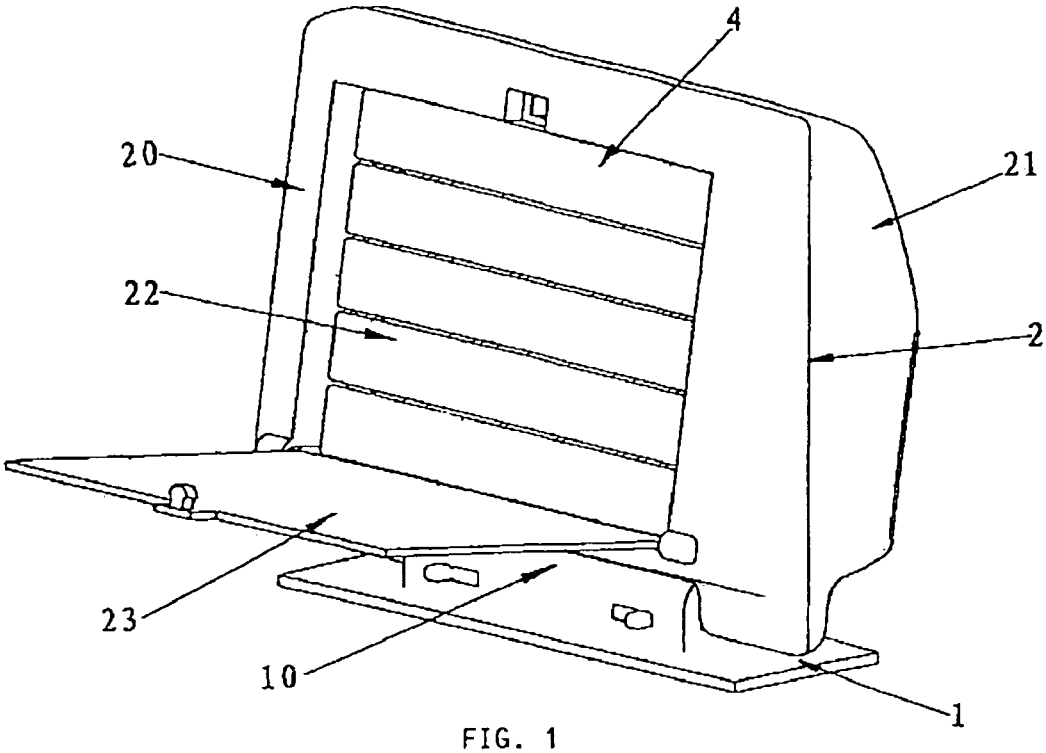
FIG. 1 is a schematic prospective illustration of a display panel.
Figure 2:
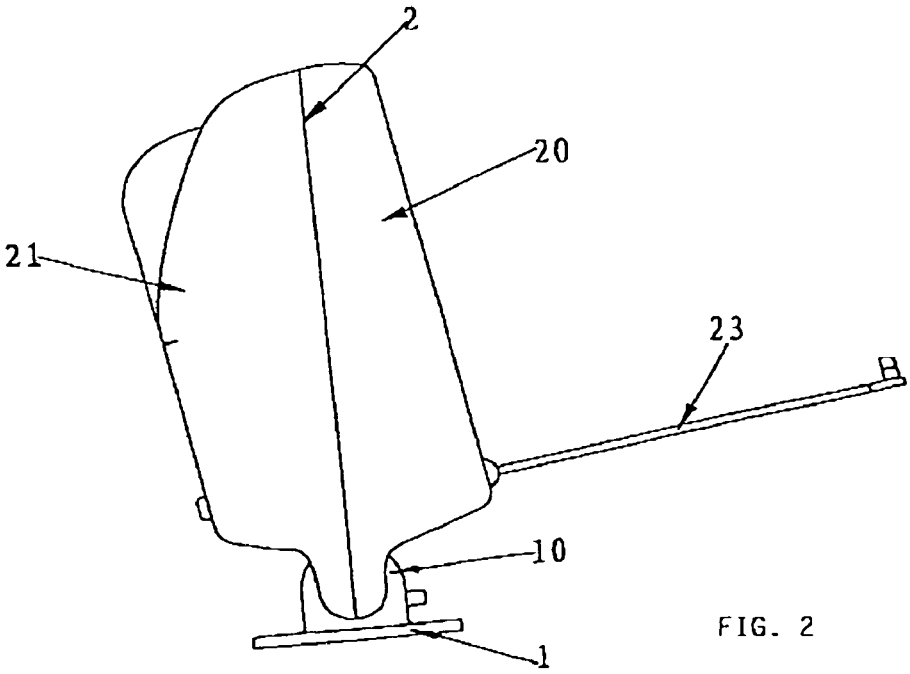
FIG. 2 is a schematic end elevation of the display panel.
Figure 3:
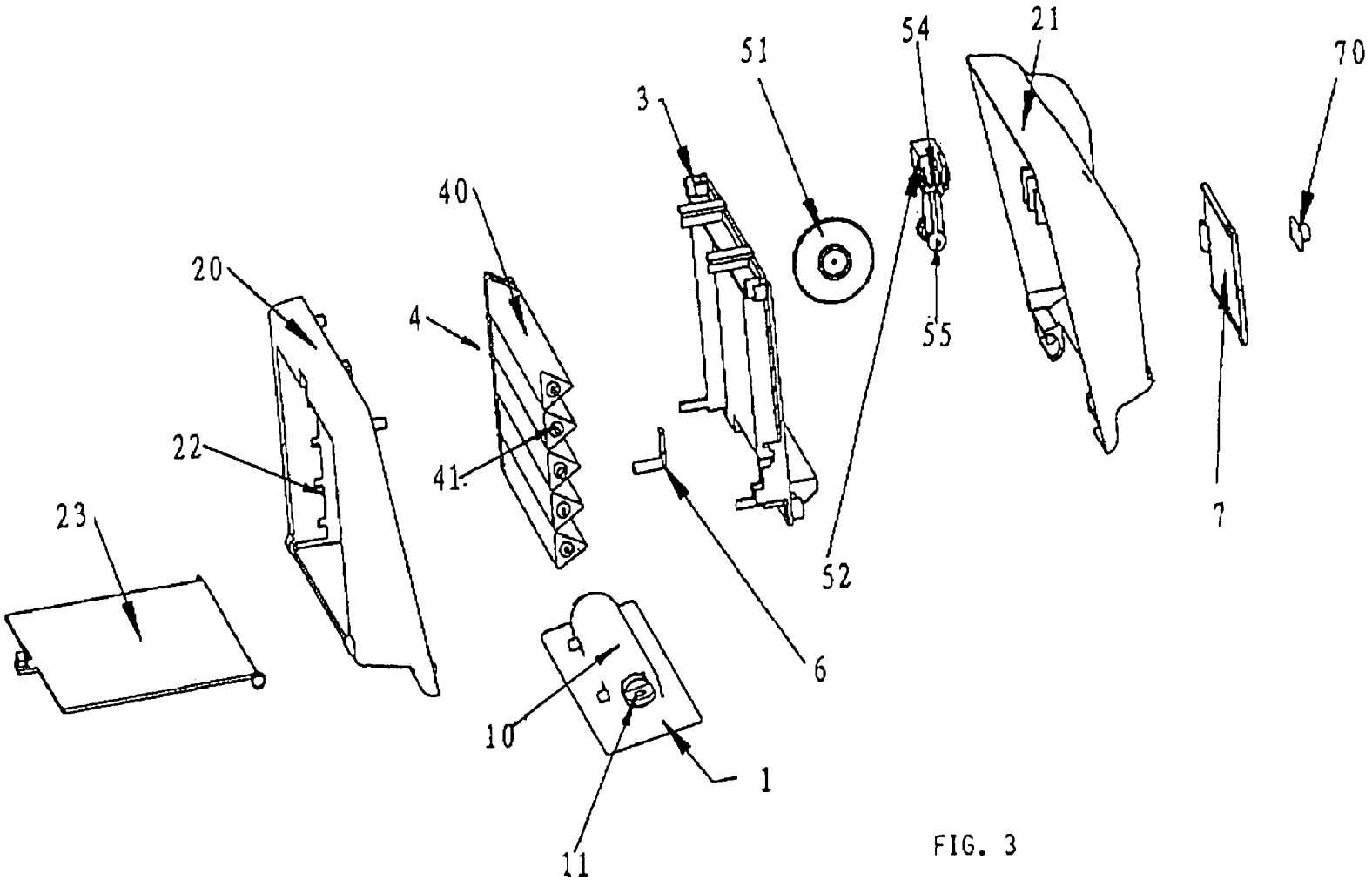
FIG. 3 is a schematic parts-exploded perspective illustration of the display panel.
Figure 4:
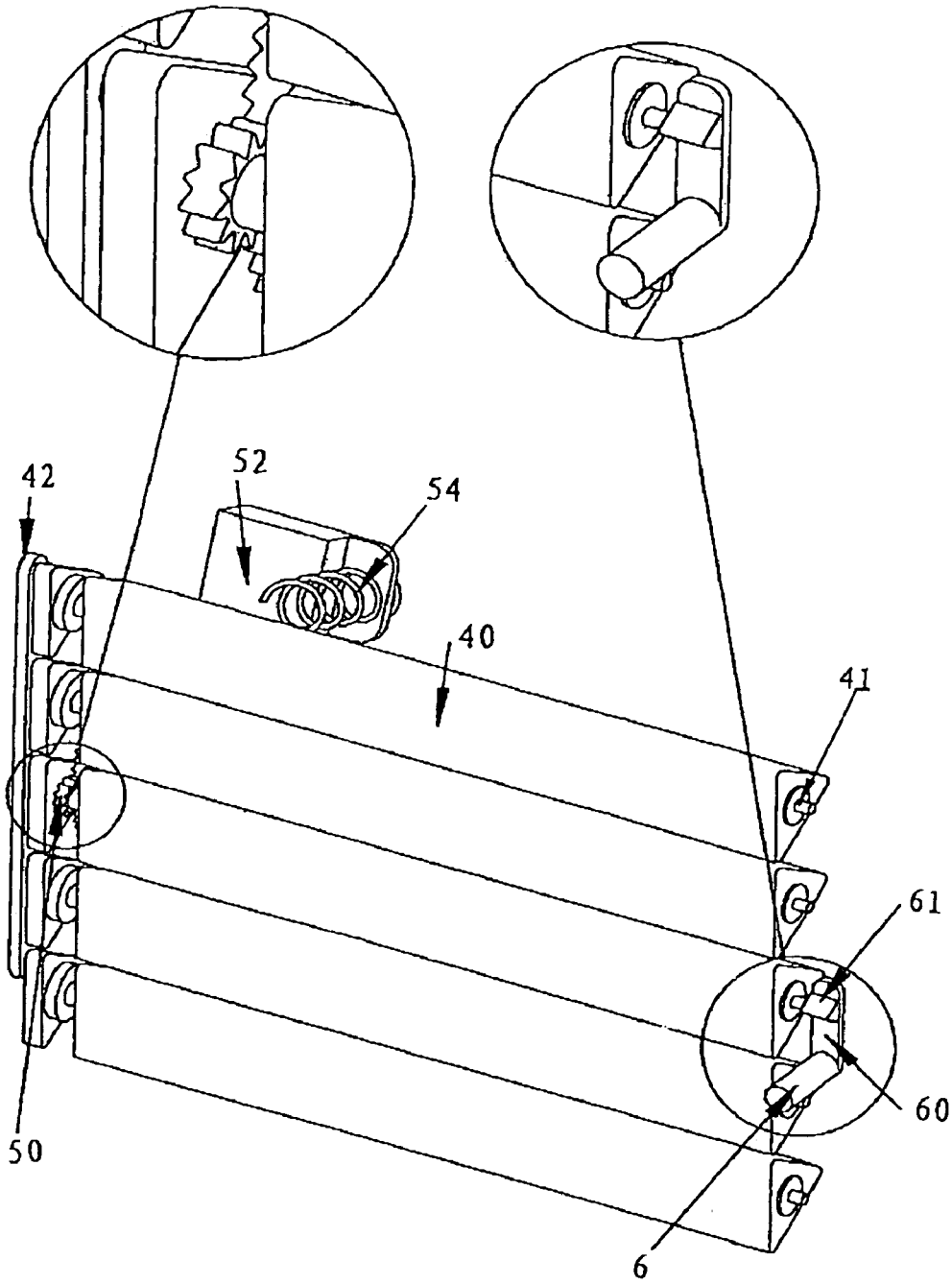
FIG. 4 is a schematic and details illustration of an array of parallel display elements and associated moving mechanism.
Figure 5:
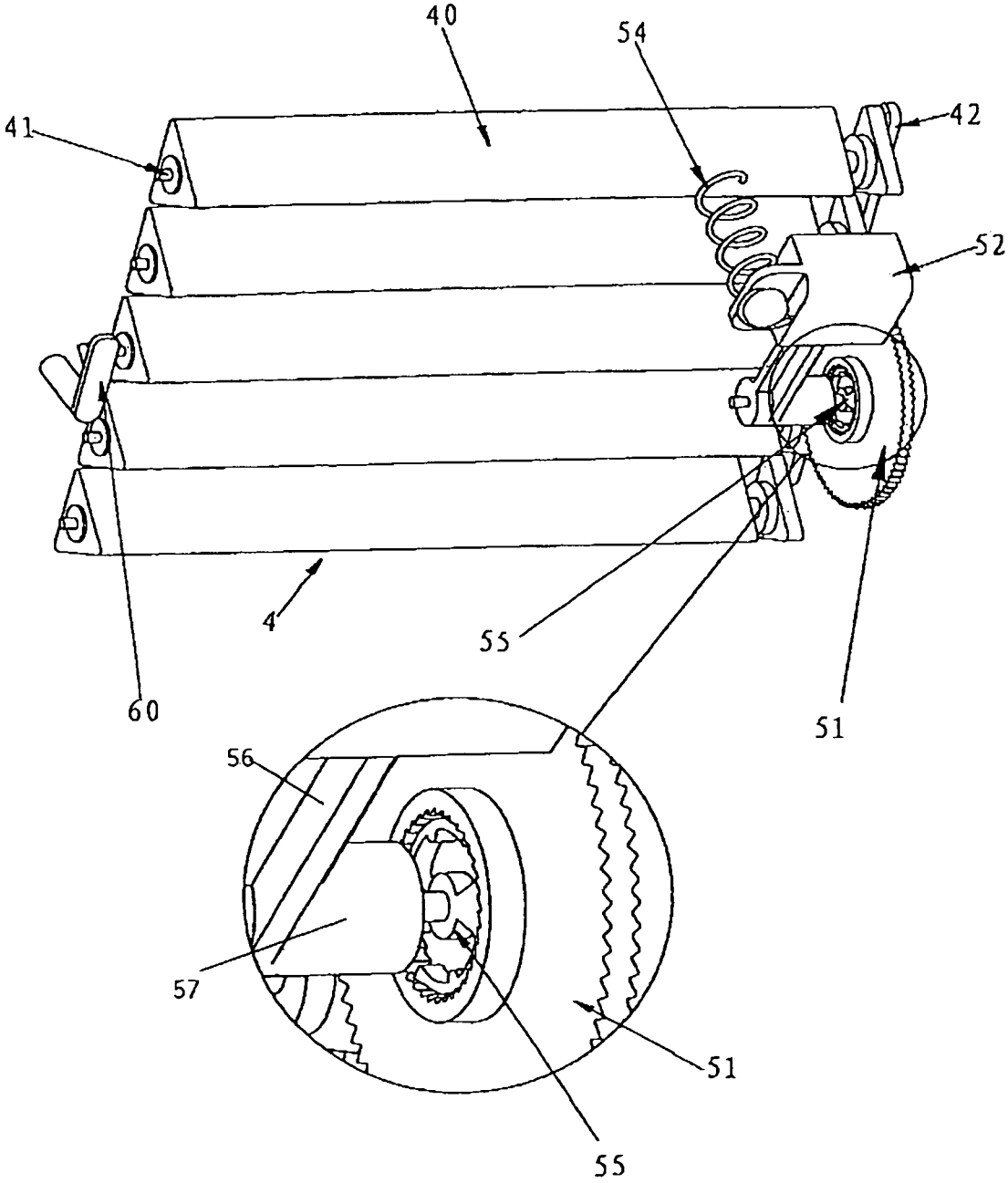
FIG. 5 is a schematic prospective illustration of the back of the array of display elements.

In the accompanying drawings there is depicted schematically a display panel comprising a case front 20 joined at 2 to a case back 21—both typically formed of moulded plastics material. There is a display opening 22 that can be concealed behind a hinged cover 23 when desired.

There is a hinge 10 by which the casing parts are mounted to a base 1 that can have double-sided adhesive tape on its bottom surface for securing the display panel to a motor vehicle dashboard.

Mounted behind the display opening in an array 4 of display elements 40 each of triangular cross-section. Each display element 40 is mounted upon a shaft or pair of pins 41 to the casing interior. There is a compartment having a cover 7 for securing batteries, should it be desired to provide illumination for the display elements 40.

Each display element 40 has a pin interacting with a link 42. If one of the display elements 40 rotates, the link 42 ensures that the remainder of the display elements rotate in unison therewith.

One of the display elements has a triangular cam at its end. There is an elastic piece 60 located within the casing and against which the flat faces of the triangular cam bear to retain a fixed display orientation of the display element until it is caused to rotate The bar 60 is mounted upon a resilient post 6.

In order to affect periodic rotation of the display elements there is located within the casing a mass 52 mounted at the end of an arm 56. The arm 56 extends from a hub 57. There is a ratchet mechanism 55 (comprising an annulus 512 having internal ratchet teeth 510) alongside and attached to the hub 57. The ratchet mechanism comprises inwardly facing ratchet teeth against which spring elements bear. The ratchet is formed integrally with a driving gear 51 having teeth 511 and ensures that the hub can cause rotation of the driving gear 51 in one direction only.

There is a spring 54 attached alongside the mans 52 at the distal end of the arm 56 that provides a buffer and bounce effect for rebound movement of the mass 52.

Figure 6:
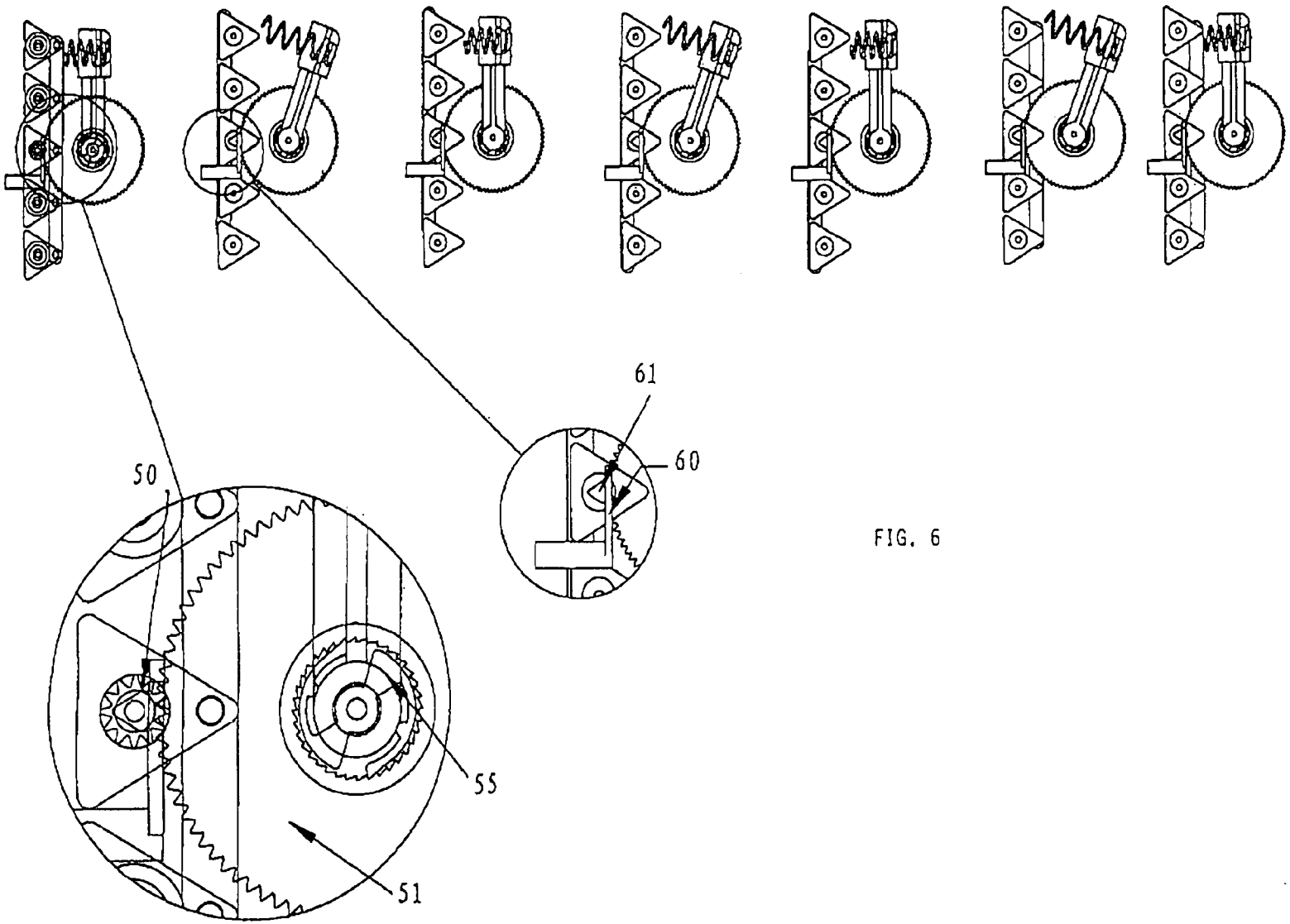
FIG. 6 is a schematic sequence diagram showing rotation of the display elements in use, FIG. 7 in a schematic cross-sectional end elevation of the display panel.
Figure 7:
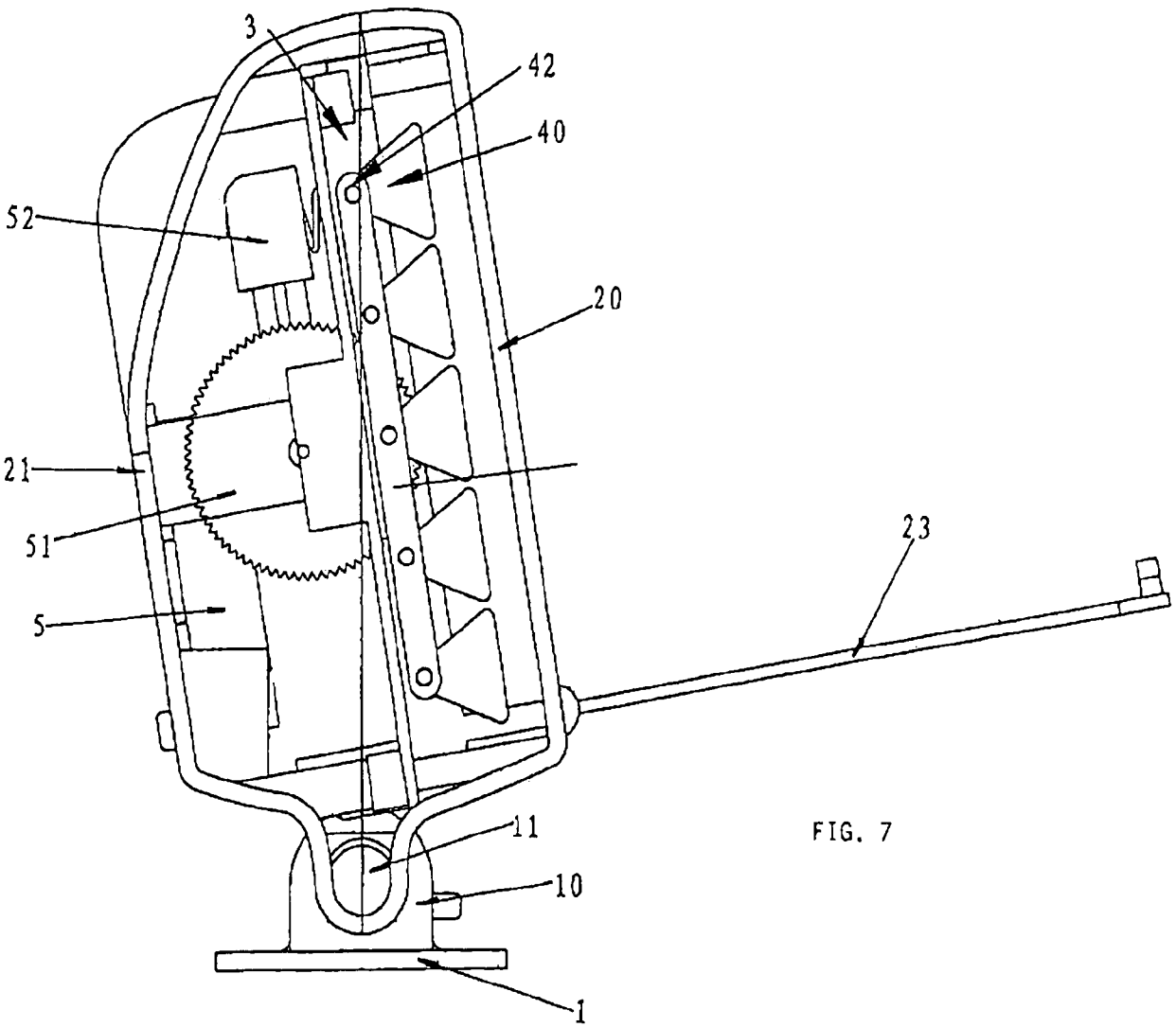
Figure 8:
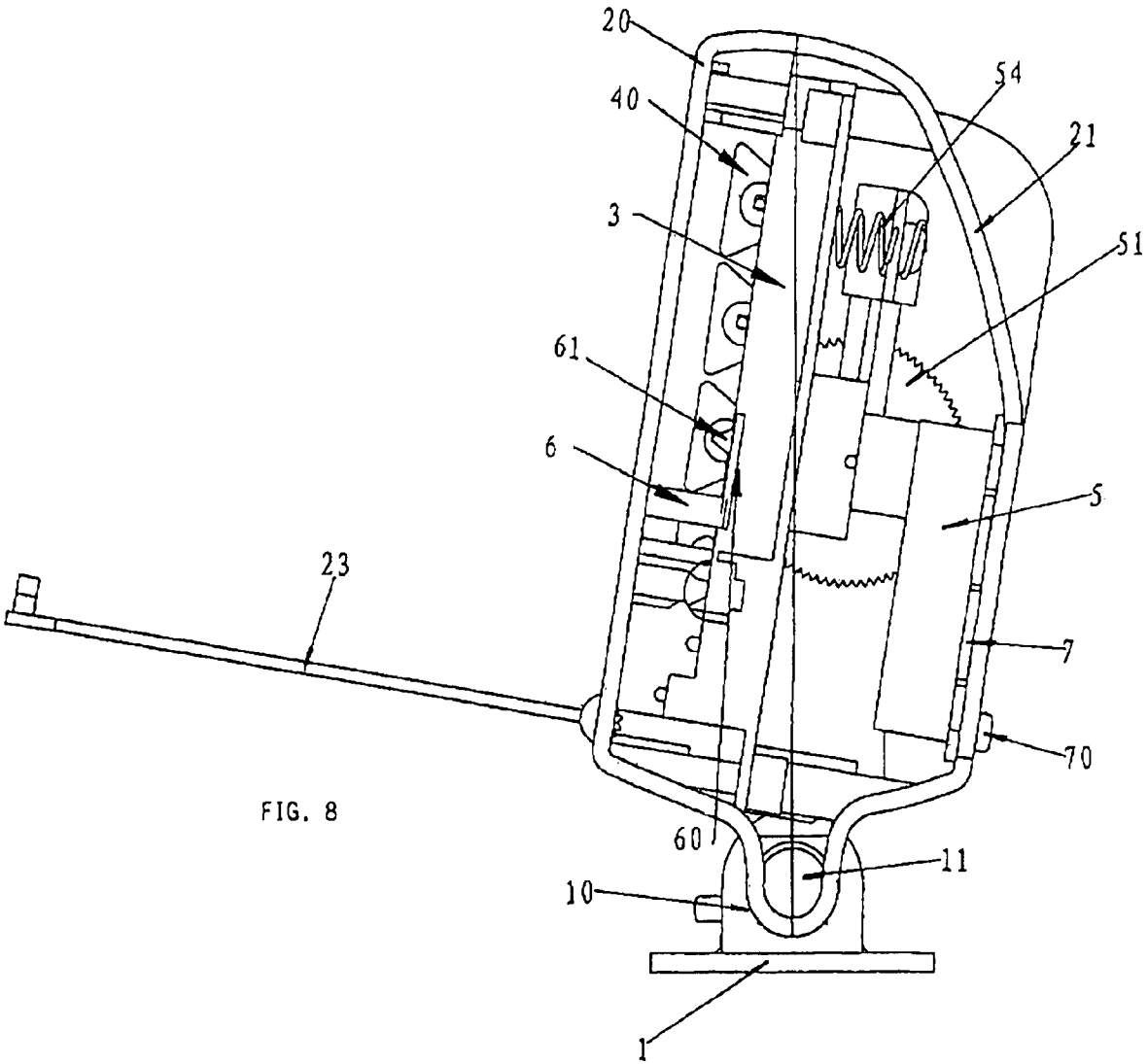
FIG. 8 is a schematic cross-sectional elevation of the other end of the display panel.
Figure 9:
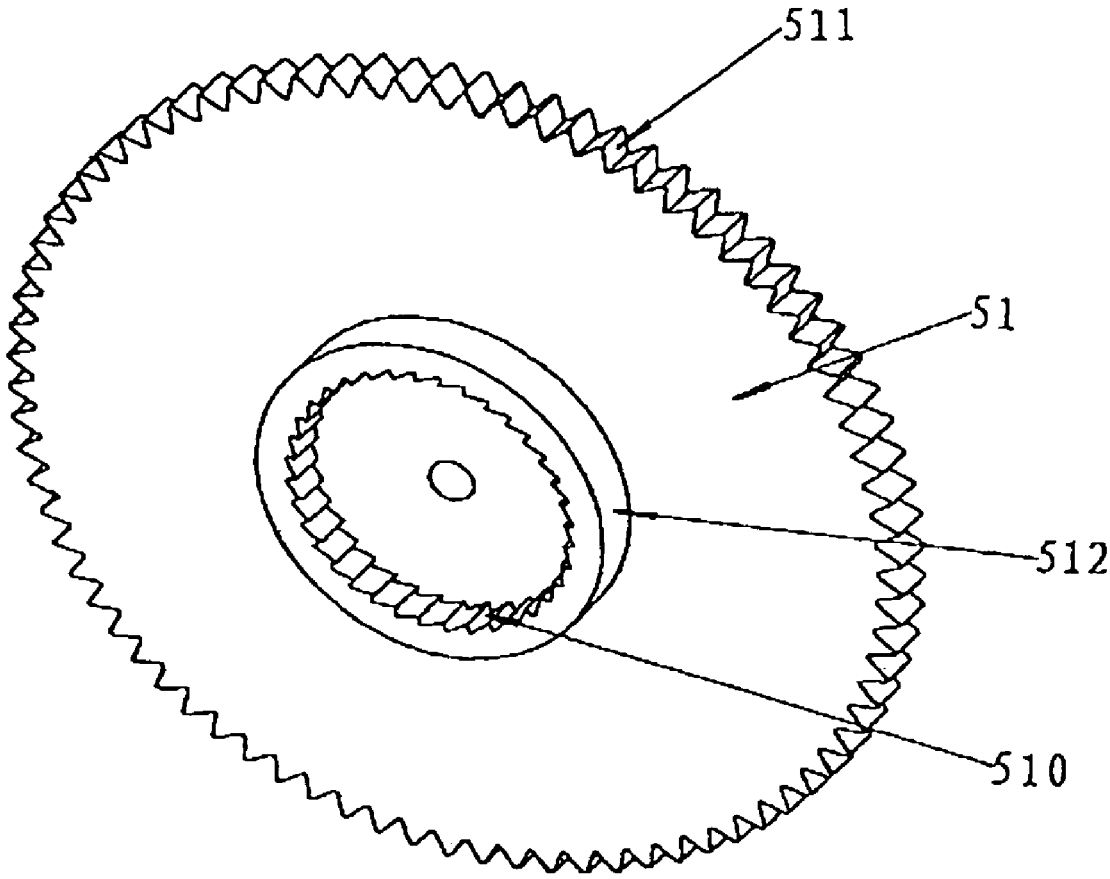
FIG. 9 is a schematic illustration of a driving gear and ratchet forming part of the mechanism of the display panel.

The driving gear 51 is in mesh with a driven gear 50 fixed at the end of one of the display elements 40. In use, the display device is mounted upon the dashboard of a motor vehicle. When the motor vehicle accelerates and decelerates or crosses a slope such as a crest or trough in a road, the mass 52 moves back and forth relative to the casing as shown in the sequence of FIG. 6.

As a result, the display changes as the vehicle stops and starts in traffic. It should be noted in this regard that the display elements have image segments thereon that become contiguous with one another to form an overall display image. The three faces of the display elements have segments of different images.

It should be appreciated that modifications and alterations obvious to those skilled in the art are not to be considered as beyond the scope of the present invention. For example, rather than providing a straight link between each of the display elements, a toothed belt or interengaging gears might be provided.

What is claimed is:

1. A display panel comprising:

a casing;

a plurality of parallel display elements rotatably mounted within the casing;

a mass that can move within the casing;

a mechanism with which the mass interacts such that upon movement of the mass relative to the casing, the mechanism affects rotation of the display elements;

a driven gear at one end of one of the display elements and wherein the mechanism comprises an arm to an end of which the mass is attached, the arm being connected at its other end to a drive gear having a plurality of teeth in mesh with the driven gear; and one of the display elements having a multi-faced cam with an elastic piece to hold that element in a fixed display orientation until it is turned by the mechanism.

2. The display panel of claim 1 wherein each display element is triangular in cross-section.

3. The display panel of claim 2 further comprising a link connecting each display element such that rotation of one display element causes rotation of the other elements.

4. The display panel of claim 1 further comprising a ratchet by which the arm is attached to the driving gear.

5. The display panel of claim 1 further comprising a base to which the casing is pivotally attached.

6. The display panel of claim 5 wherein the base has a double-sided adhesive by which it can be attached to a motor vehicle dashboard.

7. A display panel comprising:

a casing;

a plurality of parallel display elements rotatably mounted within the casing, a mass that can move within the casing;

a mechanism with which the mass interacts such that upon movement of the mass relative to the casing, the mechanism affects rotation of the display elements;

a spring attached to the mass to define a limit of movement of the mass and to provide rebound energy thereto; and one of the display elements having a cam interacting with an elastic piece to hold that element in a fixed display orientation until it is turned by the mechanism.

8. The display panel of claim 7 further comprising a base to which the casing is pivotally attached.

9. The display panel of claim 8 wherein the base has a double-sided adhesive by which it can be attached to a motor vehicle dashboard.

10. A display panel comprising:

a casing;

a plurality of parallel display elements being triangular in cross-section and rotatably mounted within the casing;

a mass that can move within the casing;

a mechanism with which the mass interacts such that upon movement of the mass relative to the casing, the mechanism affects rotation of the display elements; and a link connecting each display element such that rotation of one display element causes rotation of the other elements, wherein one of the display elements has a multi-faced cam interacting with an elastic piece to hold that element in a fixed display orientation until it is turned by the mechanism.

11. The display panel of claim 10 further comprising a base to which the casing is pivotally attached.

12. The display panel of claim 11 wherein the base has a double-sided adhesive by which it can be attached to a motor vehicle dashboard.

* * * * *